US005085378A

United States Patent [19]

Güttler

[11] Patent Number: 5,085,378

[45] Date of Patent: Feb. 4, 1992

[54] SYSTEM FOR PREPARING ROVING BOBBINS

[75] Inventor: Hermann Güttler, Uhingen, Fed. Rep. of Germany

[73] Assignee: Zinser Textilmaschinen GmbH, Ebersbach/Fils, Fed. Rep. of Germany

[21] Appl. No.: 549,395

[22] Filed: Jul. 6, 1990

[30] Foreign Application Priority Data

Jul. 13, 1989 [DE] Fed. Rep. of Germany ..... 3923071

[51] Int. Cl.[5] ..... B65H 55/00

[52] U.S. Cl. ..... 242/172; 242/36; 242/118.3; 242/125.2; 242/159; 242/164

[58] Field of Search ..... 242/172, 159, 164, 165, 242/118.3, 118.31, 118.32, 36, 37 R, 125.2, 125.3; 206/398, 400

[56] References Cited

U.S. PATENT DOCUMENTS

| | | | |
|---|---|---|---|
| 954,562 | 4/1910 | Cone | 242/172 X |
| 2,647,625 | 8/1953 | Mason et al. | 242/125.2 X |
| 3,693,906 | 9/1972 | Robinson | 242/164 X |
| 4,084,767 | 4/1978 | Witt | 242/164 |

FOREIGN PATENT DOCUMENTS

| | | | |
|---|---|---|---|
| 692591 | 8/1964 | Canada | 242/172 |
| 3635140 | 4/1988 | Fed. Rep. of Germany | 242/36 |
| 1211855 | 10/1959 | France | 242/125.2 |
| 454555 | 10/1936 | United Kingdom | 242/164 |

*Primary Examiner*—Stanley N. Gilreath

*Attorney, Agent, or Firm*—Herbert Dubno; Andrew M. Wilford

[57] ABSTRACT

A system for preparing for transport roving bobbins having a multiplicity of roving windings and a free end carried on an elongated bobbin core comprises a holder engageable with the windings for retaining the free end tightly against the windings. This holder can be an annular element or elastically deformable ring engaged at least partially around the windings on the bobbin and made of a durable synthetic resin. The ring can be discontinuous, formed with a crosswise throughgoing slot and of arcuate outwardly concave section. The outwardly concave shape is useful for engagement by an automatic handling fork.

9 Claims, 2 Drawing Sheets

SYSTEM FOR PREPARING ROVING BOBBINS

FIELD OF THE INVENTION

The present invention relates to the handling and preparing roving bobbins. More particularly this invention concerns a system for handling roving bobbins for transport between the fly frame and the spinning apparatus.

BACKGROUND OF THE INVENTION

Roving is typically wound at a fly frame on a roving bobbin that is formed as a basically featureless cylindrical tube. The yarn package thus formed is then typically transported from the fly frame to a spinning apparatus where the roving is spun into yarn or thread. The two operations are almost invariably carried out at locations removed from each other, often in different plants. Thus a common problem is to keep the roving from coming loose and unwinding from the package between operations. This problem is particularly irksome when the roving is made from shiny synthetic fibers which do not tend to stick together.

It is known to flatten the roving by means of plates engaging the rotating roving package in order to prepare the roving package for transport. In German patent document 3,733,743 the roving bobbin is provided with removable end plates that hold down the roving end. Such plates can only hold a limited amount of the roving.

OBJECTS OF THE INVENTION

It is therefore an object of the present invention to provide an improved system for handling a roving bobbin.

Another object is the provision of such an improved system for handling a roving bobbin which overcomes the above-given disadvantages, that is which ensures that the free end of the windings of roving on the bobbin is controlled as the package is transported or the like.

Another object is an improved method of preparing roving bobbins for transport

SUMMARY OF THE INVENTION

A system for preparing for transport roving bobbins having a multiplicity of roving windings and a free end carried on an elongated bobbin core according to this invention comprises a holder engageable with the windings for retaining the free end tightly against the windings. This holder can be an annular element or elastically deformable ring engaged at least partially around the windings on the bobbin and made of a durable synthetic resin. The ring can be discontinuous, formed with a crosswise throughgoing slot and of arcuate outwardly concave section The outwardly concave shape is useful for engagement by an automatic handling fork.

In order that this ring can be carried on the bobbin at all times, that is before the roving supply is wound on it and while the supply is being pulled off for spinning, the bobbin is formed offset from the windings with a radially outwardly open seat in which the ring is elastically engageable. Furthermore the bobbin is provided underneath the windings with a high-visibility covering. Thus an operator or an automatic reloading machine can readily detect when the roving supply on the bobbin is exhausted and can reload the respective station. For easiest recognition the covering is reflective.

The method of preparing for transport roving bobbins according to this invention simply comprises the step of fitting to the bobbin over the winding a holder retaining the free end of the roving tightly against the windings.

DESCRIPTION OF THE DRAWING

The above and other objects, features, and advantages will become more readily apparent from the following, reference being made to the accompanying drawing in which.

SPECIFIC DESCRIPTION

Figure 2:
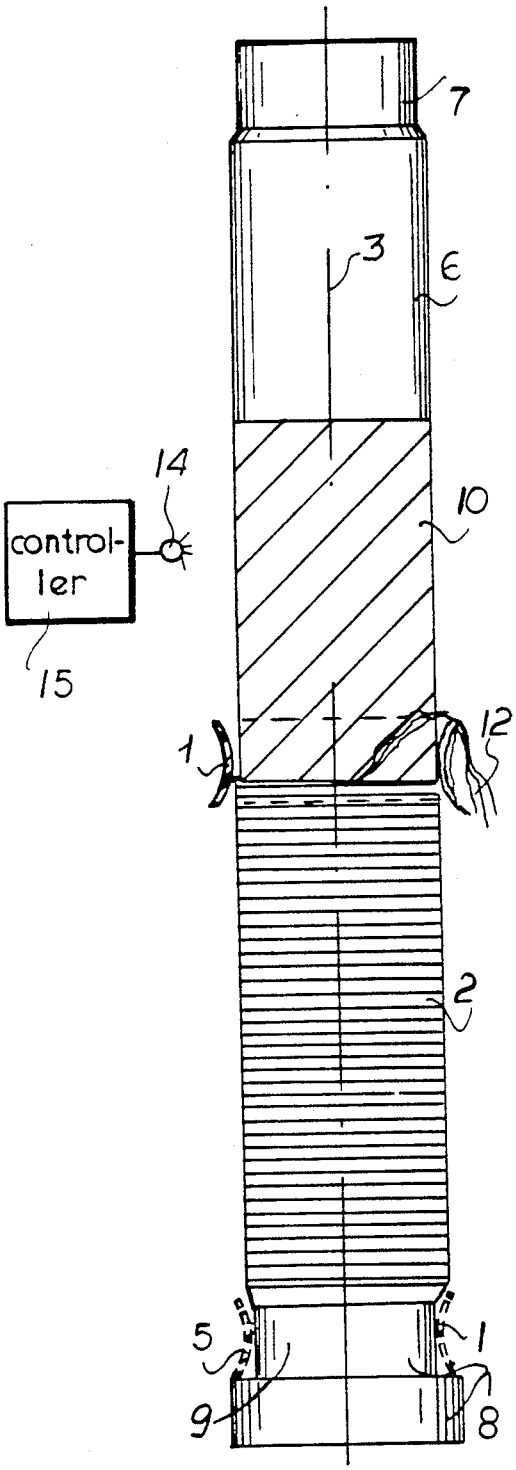
FIG. 2 is a partly diagrammatic side view of the bobbin but with the holder ring shown in section and also ready for transport from the spinning apparatus to the fly frame.
Figure 1:
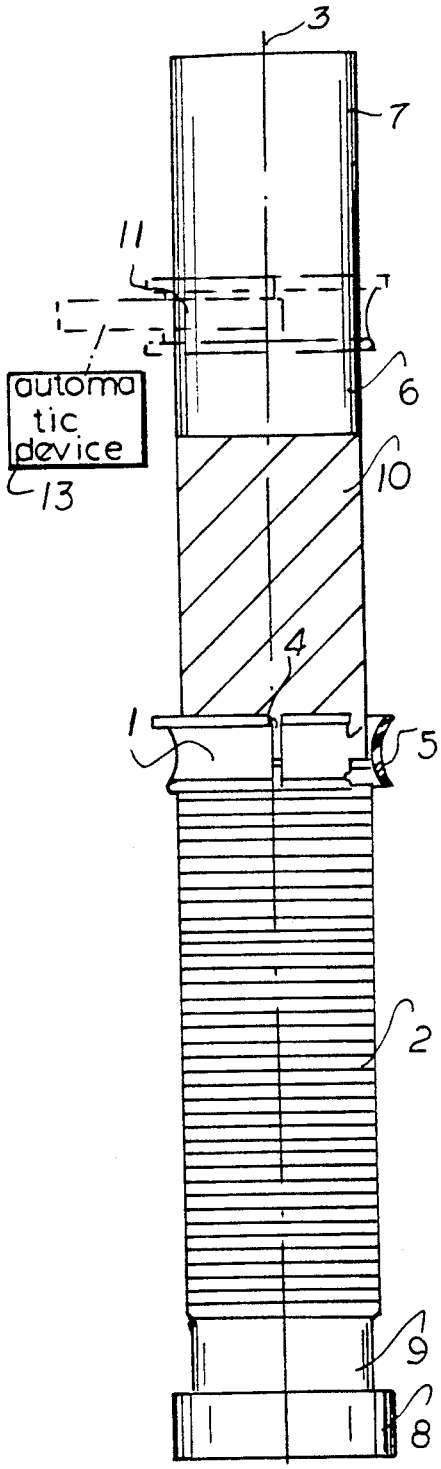
FIG. 1 is a side view of a bobbin according to this invention ready for transport from the spinning apparatus to the fly frame.
Figure 3:
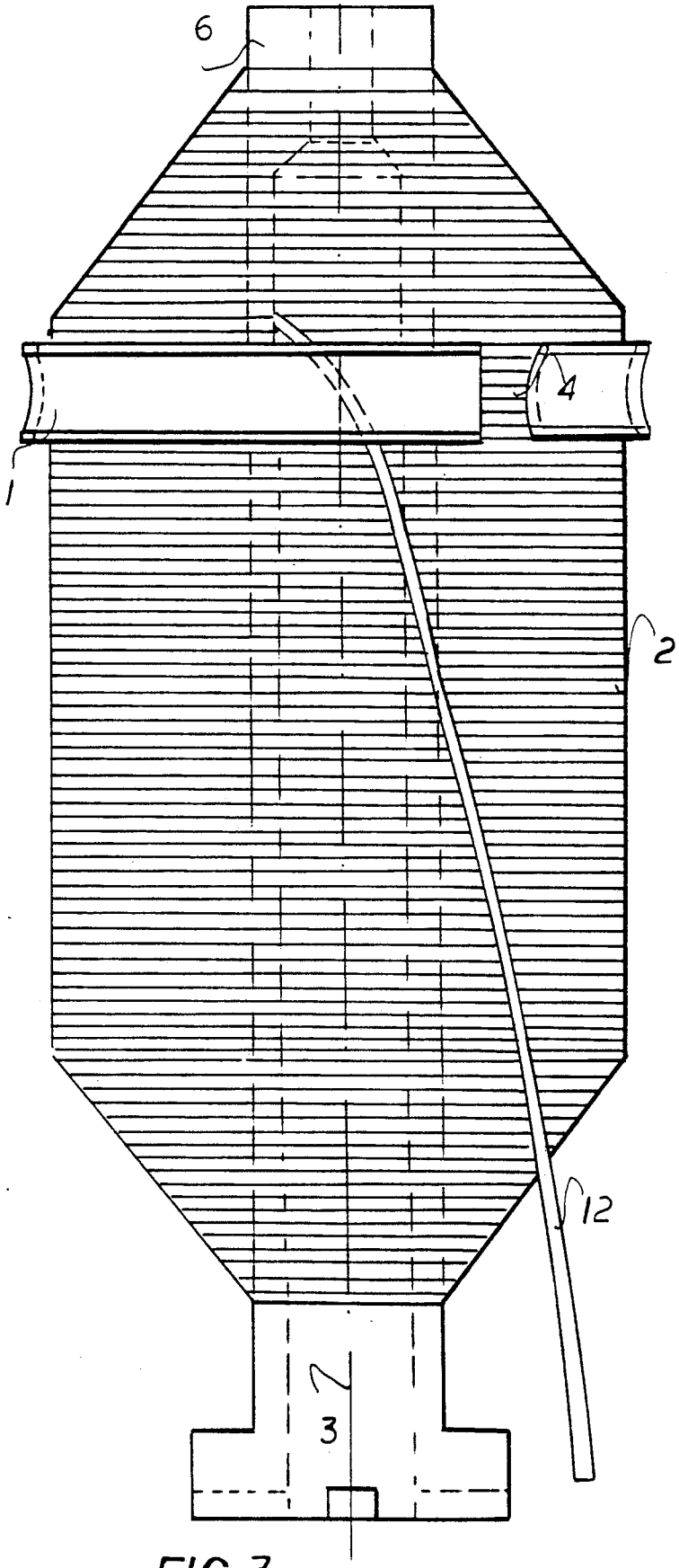
FIG. 3 is a side view of a full bobbin.

As seen in FIG. 1 a bobbin 6 formed as an essentially featureless cylindrical tube centered on an upright axis 3 carries a multiplicity of turns 2 of roving having a free end 12 (FIGS. 2 and 3). In FIGS. 1 and 2 the supply of roving is substantially depleted and in fact half of the core 6 is exposed.

As is known such a roving package is formed on a fly frame and is then normally transported to an overhead creel arrangement of a spinning apparatus. During transport to the spinning location it is important to keep control of the free end 12. Once virtually all of the roving is unwound from the bobbin 6 the spinning operation is stopped so the filament can be cut and united with the leading end of another package so that the spinning device does not have to be rethreaded.

According to the invention a holding ring 1 formed with a split 4 is fitted over the windings 2 level with the free end 12 to hold same in place. This ring 1 is of C-section and forms an outwardly open concave seat 5 in which is engageable a fork 11 of an automatic loading and unloading device 13 This internally rounded shape also makes it easy to slide the ring 1 along the windings 2 without catching on them for positioning or removing the ring 1. A photoptical system can be provided to automatically determine where the free end 12 is so that the automatic device 13 positions the ring I there.

In addition the bobbin 6 can be formed with an inset lower end or seat 9 adjacent a bottom collar 8 in which the ring can sit while roving is being wound to or from the bobbin 6. In FIG. 2 the ring 1 is shown in phantom in the lower seat 9 although in practice only one such ring 1 is needed on a bobbin 6. Another such seat or recess 7 can be provided at the upper end of the bobbin 6. The seats-7 and 9 each have a diameter that is slightly less than that of the rest of the bobbin 6. The ring 1 has an inside diameter that is slightly greater than the outside diameter of the bobbin 6 but slightly less than that of the bobbin 6 plus one layer of roving.

As seen in FIG. 2 in order to facilitate automatic replacement of an exhausted roving package, the bobbin 6 is provided underneath the windings 2 with a reflective covering 10 that can be recognized by an electric eye 14 of an automatic controller 15. This device 15 can sound an alarm to summon a machine operator or it can operate an automatic doffing apparatus.

The ring 1 is moved to hold down the end of any roving remaining on the bobbin for transport of the bobbin from the spinning apparatus to the fly frame.

FIG. 3 shows a full package illustrating how the ring 1 can be spread to hold the end 12 even on such a full package. The ring 1 is engaged over the end 12. The ring 1 can in fact be slid past the free end 12 to the same location on every roving package so that the free end 12 in effect extends out at the same level. This greatly facilitates subsequent handling.

Of course other embodiments of the invention are possible. For instance a large thumbtack-like device can be poked into the roving to hold down the free end Alternately a wholly elastic band can be snapped around the package An elastic strap with a Velcro TM hook-and-barb fastener could similarly be used.

I claim:

1. In combination:

a roving bobbin having a multiplicity of roving windings and a free end carried on an elongated bobbin core, the bobbin being formed adjacent the windings with a radially outwardly open seat; and an annular elastically deformable ring engaged at least partially around the windings on the bobbin, retaining the free end tightly against the windings, and elastically engageable in the seat.

2. The combination defined in claim 1 wherein the bobbin is provided underneath the windings with a high-visibility covering.

3. The combination defined in claim 2 wherein the covering is reflective.

4. The combination defined in claim 1 wherein the ring is discontinuous and formed with a crosswise throughgoing slot.

5. In combination with a roving bobbin having a multiplicity of roving windings and a free end carried on an elongated bobbin core, a preparing system comprising an annular elastically deformable ring engaged at least partially around the windings on the bobbin and retaining the free end tightly against the windings, the ring being discontinuous, of arcuate outwardly concave section, and formed with a crosswise throughgoing slot.

6. The combination defined in claim 5 wherein the ring is shaped to fit with an automatic handling fork.

7. The combination defined in claim 5 wherein the ring is made of a synthetic resin.

8. In combination:

an elongated generally featureless bobbin extending along and centered on an axis;

a supply of roving constituted as a multiplicity of windings wound on the bobbin and having a free end; and an elastic split ring of outwardly concave U-section engaged around the bobbin over the windings and holding the free end tightly against the windings.

9. The combination defined in claim 8 wherein the bobbin is provided with a reflective coating underneath the windings.

* * * * *